United States Patent [19]

Christian et al.

[11] 4,344,211

[45] Aug. 17, 1982

[54] HIGH PRESSURE SIZING APPARATUS AND METHOD

[75] Inventors: Charlie R. Christian, Lafayette; Jack C. Gaskins, Lanett, both of Ala.; Jack Hamrick, West Point, Ga.; Norman L. Reed, Lanett, Ala.

[73] Assignee: West Point Foundry & Machine Co., West Point, Ga.

[21] Appl. No.: 161,702

[22] Filed: Jun. 23, 1980

[51] Int. Cl.[3] ..... D06B 3/04; D06B 15/02

[52] U.S. Cl. ..... 28/183; 100/37; 100/172; 68/258; 68/22 R

[58] Field of Search ..... 100/37, 121, 163 R, 100/163 A, 168, 169, 170, 172, 176, 211; 68/22 R, 253, 256, 258; 28/183; 118/114, 117, 122, 420

[56] References Cited

U.S. PATENT DOCUMENTS

| | | | |
|---|---|---|---|
| 346,639 | 8/1886 | Canning . | |
| 2,351,534 | 6/1944 | Norcross . | |
| 2,643,475 | 6/1953 | Klopfenstein | 100/172 X |
| 2,698,984 | 1/1955 | Griffin | 28/183 |
| 2,776,510 | 1/1957 | Klopfenstein | 100/172 X |
| 2,851,869 | 9/1958 | Quoos et al. | 68/258 |
| 2,977,622 | 4/1961 | Freeze et al. | 28/183 |
| 2,992,626 | 7/1961 | Kabelitz . | |

FOREIGN PATENT DOCUMENTS

| | | | |
|---|---|---|---|
| 1157737 | 12/1957 | France | 68/258 |

OTHER PUBLICATIONS

P. E. Exbrayat et al., "Saving Energy in High Performance Sizing Through High Pressure Squeezing", Paper by Shirley Institute, 12 Sep. 1977, Manchester, England.

*Primary Examiner*—Peter Feldman

*Attorney, Agent, or Firm*—Jones & Askew

[57] ABSTRACT

Apparatus and method for high pressure sizing, including sizing squeeze apparatus which effectively utilizes high pressure squeeze loading to remove excess sizing from the warp yarns, and thus to reduce the water evaporation requirement of the yarn. The high pressure sizing squeeze apparatus includes positive drive of the rubber-surface roll as well as the steel roll to prevent slippage which could strain the warp, and maintains a substantially invariant squeeze loading irrespective of variable tension in the roll drive. The surface speed of the rubber-covered squeeze roll may be slightly less than the surface speed of the steel roll, to reduce the torque required to drive the rubber-covered roll at relatively high squeeze pressures where substantial slippage is encountered. A torque limiter controls maximum axial drive torque supplied to the rubber-surface roll, in response to the magnitude of squeeze loading.

16 Claims, 6 Drawing Figures

HIGH PRESSURE SIZING APPARATUS AND METHOD

BACKGROUND OF THE INVENTION

This invention relates in general to applying size to a yarn product, and in particular to improved apparatus and method for high pressure squeezing in the application of size.

Size is a product and is a treatment for reducing the friction and abrasive action of a loom on the warp or longitudinal yarn bundles, in preparing for a subsequent weaving process. The commonplace application of size takes place by passing the warp yarns through a size bath to saturate the yarns with size, and then removing excess size solution by squeezing the warp between a pair of rolls. The moisture remaining in the warp yarns after the squeezing operation must be removed by passing the warp through a dryer, which typically includes a number of heated drying drums around which the warp passes to remove the remaining moisture by evaporation. The maximum speed of the sizing operation, measured in terms of lineal warp distance per unit time, is limited by the need to completely dry the sized warp, which is rewound for subsequent weaving.

The term "% add-on" is used to describe the amount of sizing product applied to the warp yarn, and this term is usually expressed as the product of the "wet pick-up" (the weight of size bath liquid applied to a unit weight of yarn) times the % solids (the proportion of size bath liquid made up of actual sizing products). The need to provide at least a desired minimum % add-on to the warp yarn has, in the past, conflicted with the desire to minimize the water evaporation requirement of the yarn immediately after passing through the squeeze rolls. The water evaporation requirement is the weight of water to be evaporated per unit weight of yarn, and reducing the water evaporation requirement decreases the amount of energy required to remove that water from a unit length of yarn.

The squeeze rolls of conventional sizing machines typically include a top rubber covered squeeze roll, and a lower stainless steel roll. The lower roll is driven to substantially synchronize its surface speed with the forward movement of the warp yarns, and the rubber covered squeeze roll is held against the bottom roll to provide a squeeze force typically on the order of ten to twenty pounds per lineal inch (PLI) in the "nip" or region of roll contact, in the prior art. While increasing the squeeze pressure theoretically would reduce the water evaporation requirement, the % add-on was reduced below a desirable amount in the past.

Sizing products which can be mixed in higher concentrations (% solids) have become available. These more highly concentrated sizing products permit a greater amount of liquid removal by squeezing, which substantially reduces the water evaporation requirement while still retaining the desired % add-on of sizing product applied to the yarn. In order to obtain the reduced water evaporation requirement, it was initially believed that the squeeze pressure simply could be increased to provide the desired increased liquid removal before the drying operation. Such prior-art attempts to increase size squeezing, however, met with several unanticipated problems. The top rubber-covered squeeze roll of conventional sizing apparatus is driven only by the friction of surface contact with the lower roll, and the combined effects of increased squeeze pressures and inherent slipperyness of sizing solutions caused intermittent or erratic slippage of the top squeeze roll relative to the bottom roll. A substantial amount of relative slippage of the rolls cannot be tolerated, because the warps must be processed under very low limits of longitudinal strain. Moreover, the amount of slippage in rotation of the rubber covered top roll, caused by rubber strain under increased squeeze force, varied as a function of the squeeze loading, so that the degree of warp strain varied depending on the particular selected squeeze loading. Initial attempts to overcome the problem of top squeeze roll slippage, brought on by attempts to decrease the water evaporation requirement by increasing the squeeze loading, thus were not successful.

Moreover, the frequent need to separate the top and bottom squeeze rolls for threading a new warp created problems with producing an effective yet inexpensive top roll drive, problems that were compounded by the need to maintain a selected squeeze loading substantially unaffected by changes in tension of the means for driving the movable top roll. Simply providing the top squeeze roll with a gear to mesh with a gear on the driven bottom roll, according to one prior art proposal, would subject the gears to damage each time the rolls were separated to thread a new warp inasmuch as rotation of either roll while disengaged could cause the gears to misregister and become damaged when reengaged.

SUMMARY OF INVENTION

According to the present invention, the foregoing and other problems of the prior art are reduced or eliminated by a high pressure sizing apparatus and method including a unique arrangement for driving the rubber covered squeeze roll of a sizing machine by applying drive torque to the roll. Stated in somewhat general terms, one aspect of the present invention is a top roll drive mechanism which remains engaged to the top rubber covered roll as that roll is moved away or toward the bottom non-resilient roll. The drive mechanism for the top roll, in preferred embodiments of the invention, maintains driving engagement with the top roll with variable drive tension applied to the top roll, without affecting the squeeze loading of the rolls. Stated more specifically, preferred embodiments of the present invention utilize mechanical drive of the top roll for compatibility with existing sizing squeeze apparatus, yet permit the top roll to be moved toward or away from the bottom roll without disengaging the drive mechanism and without affecting the driving torque applied to the top roll.

Positive drive of the top roll in a high-pressure sizing apparatus according to the present invention is improved by selecting the top rubber covered roll diameter to be slightly less than the diameter of the bottom non-resilient roll. Because the rubber covered roll is rotationally driven by frictional surface engagement with the non-resilient roll, as well as by a positive drive means according to the present invention, the rubber covered roll can be made to "overdrive" or lead the positive driving connection to that roll during relatively light squeeze loading resulting in relatively little or no surface slippage, and to "underdrive" or be driven by the positive driving connection at increased squeeze loading. A null point between overdriving and underdriving may be obtained, at which point the tendency to overdrive the rubber covered roll is substantially balanced by surface slippage relative to the driven nonresilient bottom roll. At the null point, the positive drive to the top roll applies no torque. This aspect of the present invention permits a high pressure squeeze sizing machine operable over a relatively wide range of operating squeeze force, without experiencing excessive resilient roll driving forces that would possibly damage the drive, or would require relatively expensive drive modifications.

Accordingly, it is an object of the present invention to provide an improved apparatus and method for applying sizing to warp yarns.

It is another object of the present invention to provide an improved high-pressure sizing method and apparatus.

It is yet another object of the present invention to provide a sizing method and apparatus which effectively reduces water evaporation requirement, and thus reduces the amount of energy required to dry the warp yarn.

It is a further object of the present invention to provide an improved sizing method and apparatus which operates at substantially increased squeeze loading pressures, and yet does not impart undesired longitudinal strain to the warp yarns.

Other objects and attendant advantages of the present invention will become more readily apparent from the following description of preferred embodiments.

DESCRIPTION OF PREFERRED EMBODIMENTS

Figure 1:
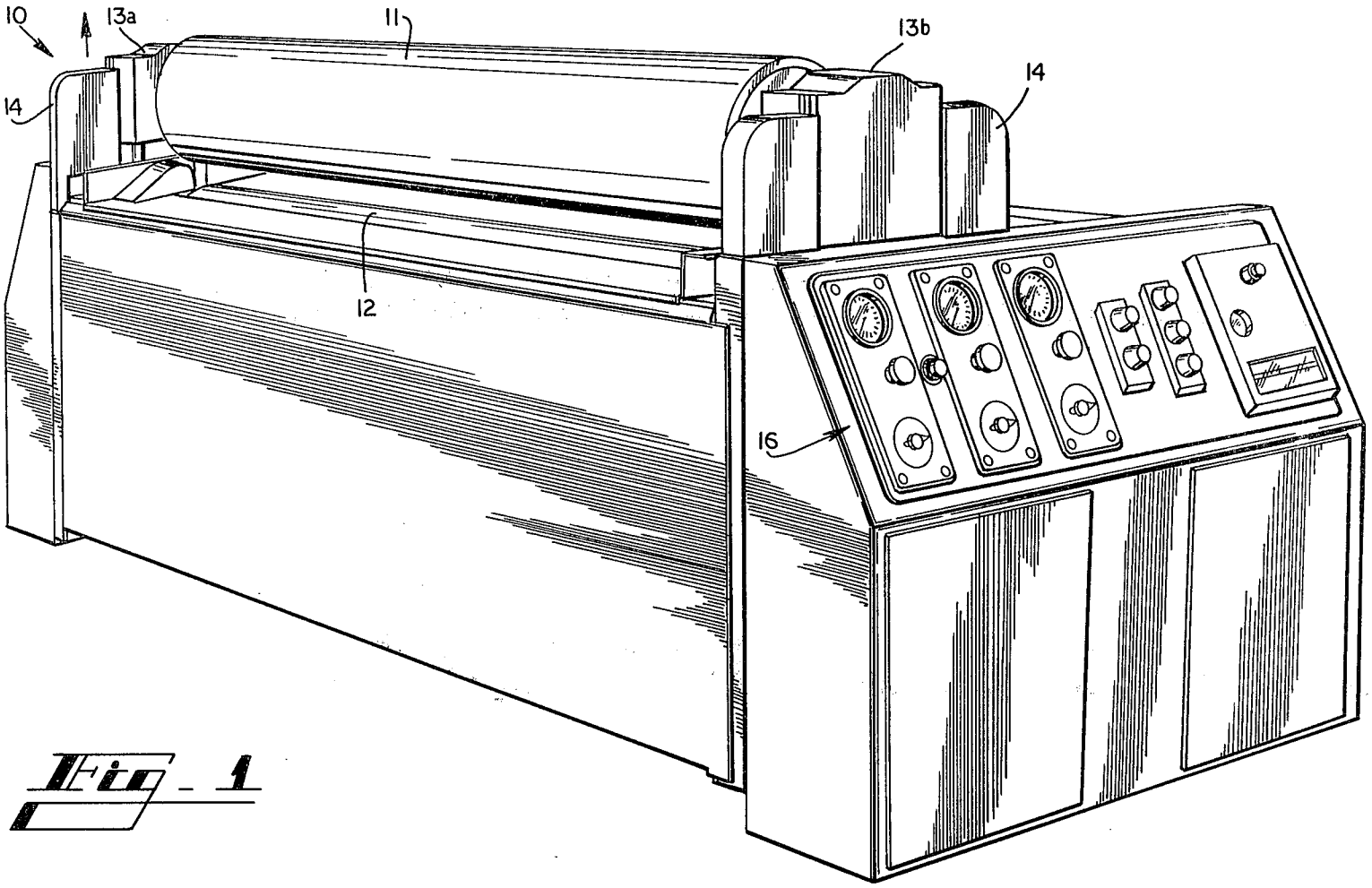
FIG. 1 is a pictorial view showing a disclosed embodiment of high pressure sizing apparatus according to the present invention.

Looking initially to FIG. 1, there is shown generally at 10 an embodiment of high pressure sizing squeeze apparatus according to the present invention. The sizing apparatus 10 includes a top squeeze roll 11 having a peripheral surface made of an elastomeric material such as rubber or the like, and a bottom squeeze roll 12 having a smooth peripheral surface of a relatively nonresilient and corrosion-resistant material such as stainless steel. Both rolls 11 and 12 are journaled for rotation in a manner described below in greater detail. The top roll 11 is journaled at its ends in a pair of bearing blocks 13*a* and 13*b* supported for movement in a vertical direction relative to the fixed end members 14.

The sizing squeeze apparatus 10, including top roll 11 and bottom roll 12, comprises squeezing apparatus through which the warp yarns (not shown) pass after the warp is initially coated with sizing solution. This initial application of liquid sizing to the warp takes place in one or more size boxes through which the warp passes before entering the high pressure sizing squeeze apparatus 10. The size boxes, along with immersion rolls and other related apparatus, are well-known to those skilled in the art, and are typically located immediately behind the squeeze apparatus 10 shown in FIG. 1.

The apparatus 10 includes a control console 16 containing controls for regulating the operation of the overall sizing apparatus. These controls may select the amount of squeeze loading applied to the warp yarns passing between the top and bottom rolls, as described below in greater detail, as well as other variable factors associated with the sizing operation and including control of apparatus (not shown) associated with the size box.

Figure 3:
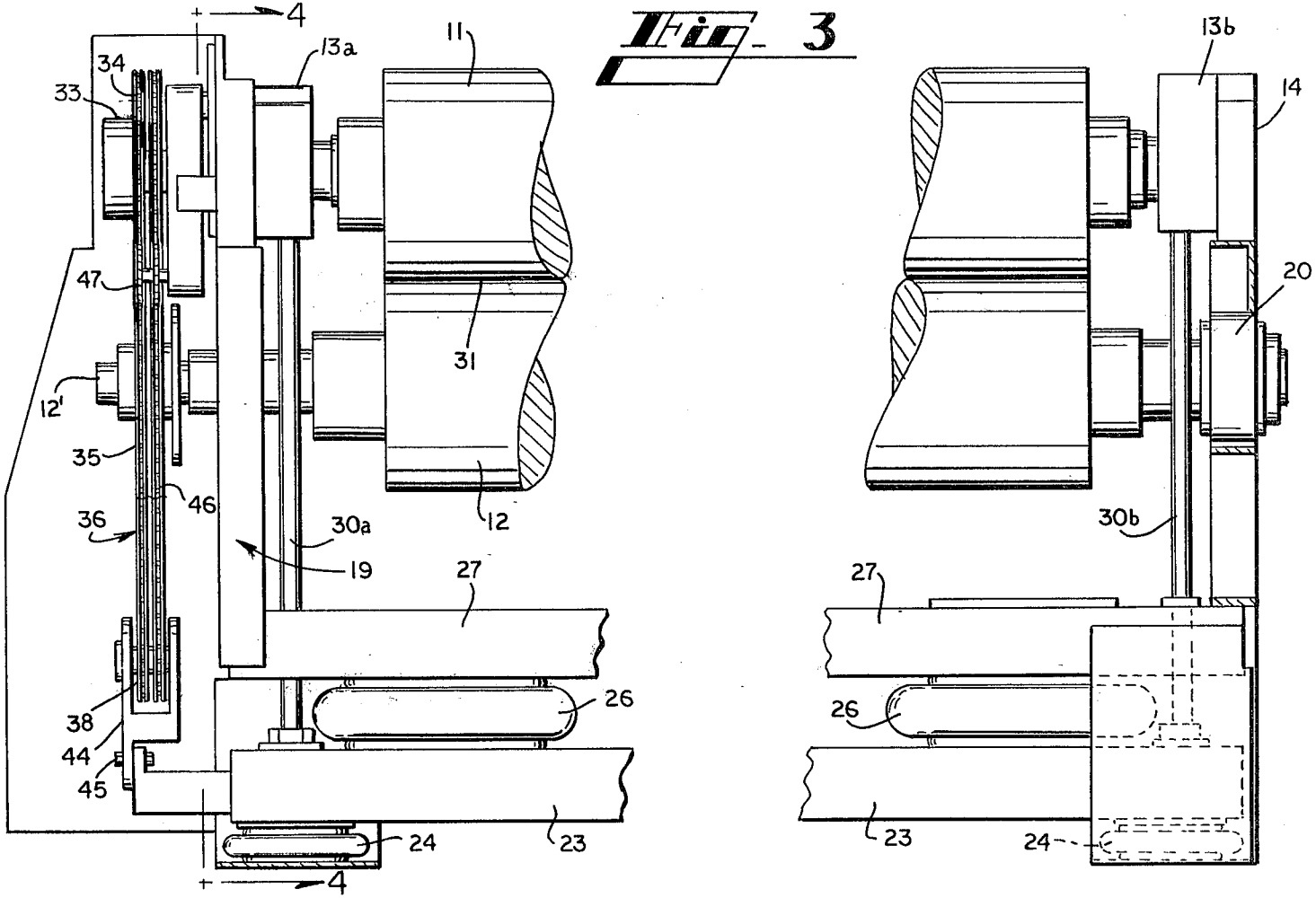
FIG. 3 is a partially sectioned and broken-away front elevation view taken along line 3—3 of FIG. 2, showing details of the top roll lifting and loading mechanism.
Figures 4, 6:
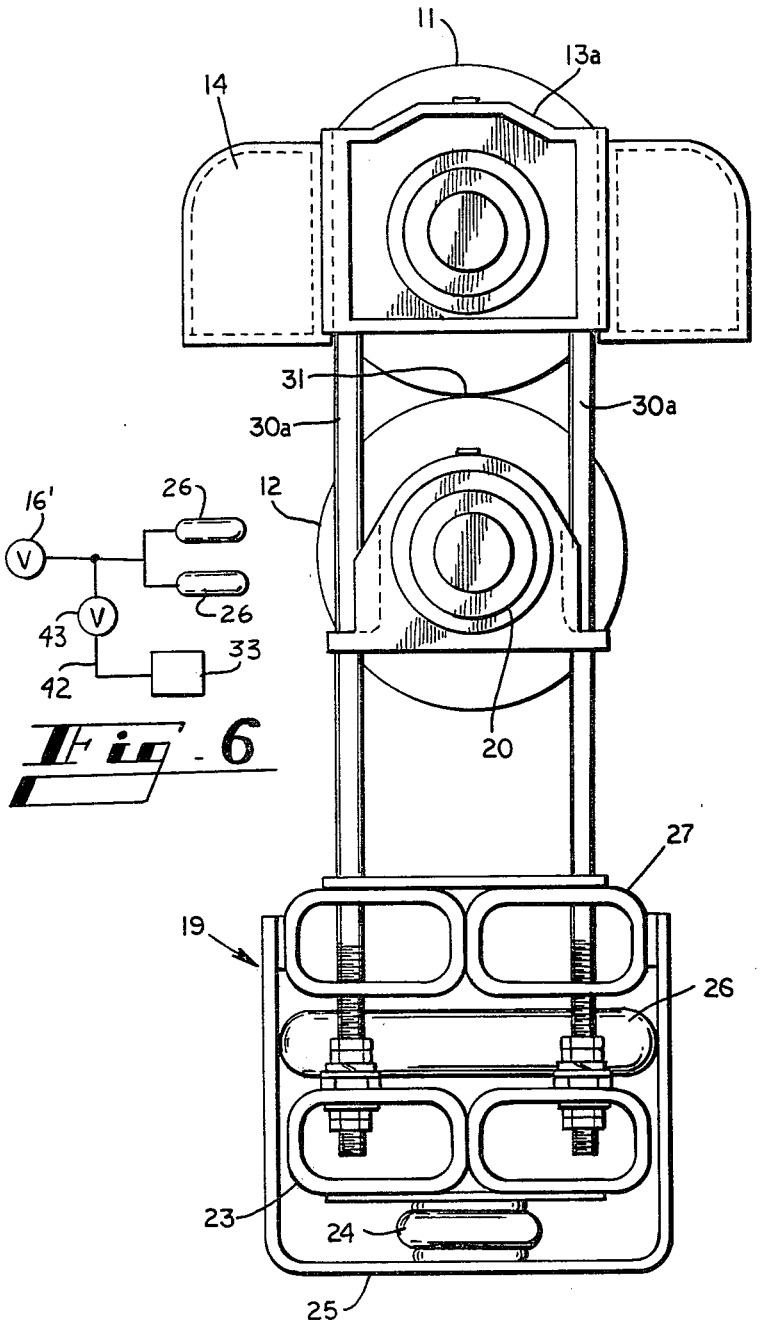
FIG. 4 is a vertical section view taken along line 4—4 of FIG. 3, showing added details of the mechanism for lifting and loading the top roll.
FIG. 6 is a schematic drawing of an operating control circuit for the top roll loading elements and the variable torque limiter.

Turning next to FIGS. 3 and 4, it is seen that the bottom roll 12 is supported for rotation on the fixed frame assembly indicated generally at 19, and providing basic structural support for the high pressure squeeze apparatus 10. The fixed end members 14 supporting the bearing blocks 13*a* and 13*b* for the top roll are rigidly connected to the frame assembly 19 and are considered to comprise part of the frame assembly, although it will be understood that the frame assembly is fabricated from a number of separate interconnected components. Journals 20 for each end of the bottom roll 12 are supported by the frame assembly 19.

Extending transversely across the apparatus 10 is the load and lift beam 23, best seen in FIGS. 3 and 4. The beam 23 is mounted for a limited extent of vertical movement relative to the frame assembly 19, and to accomplish that result the beam is supported from its underside by a pair of inflatable lifting elements 24, located near the ends of the beam. As best seen in FIG. 4, the lifting elements 24 are supported from below by the base member 25 of the frame assembly 19. Mounted above the beam 23 is a second pair of inflatable elements 26, hereafter known as loading elements. The loading elements 26 are supported from above by the fixed cross beam 27, forming part of the frame assembly 19.

The lifting elements 24 and the loading elements 26 comprise selectably expandable members such as inflatable air bags or the like, which expand in the vertical dimension (as viewed in FIGS. 3 and 4) when connected to a source of pressurized fluid. The pair of lifting elements 24, and the pair of loading elements 26, are separately connected to receive pressurized air through valves controlled at the control console 16, and it will be understood that the beam 23 is either lifted or lowered relative to the frame assembly 19, depending on whether the lifting elements 24 or the loading elements 26 are pressurized.

A separate pair of spaced-apart connecting rods 30*a* and 30*b* are attached to each end of the load and lift beam 23, and the connecting rods extend upwardly from that beam to engage the respective bearing blocks 13*a* and 13*b* supporting the top roll 11. The bearing blocks 13*a* and 13*b* are received within the surrounding fixed end members 14 for slidable vertical movement relative to the support structure. Because the bearing blocks 13*a* and 13*b* support the top roll 11, it should now be apparent that the vertical position of the top roll relative to the bottom roll 12 may be selected by controlling the vertical position of the load and lift beam 23. The magnitude of squeeze loading along the nip or contact area 31 of the two rolls is determined by the force exerted downwardly on the beam 23 by the loading elements 26, and that force is determined by the air pressure supplied to the loading elements.

Figure 2:
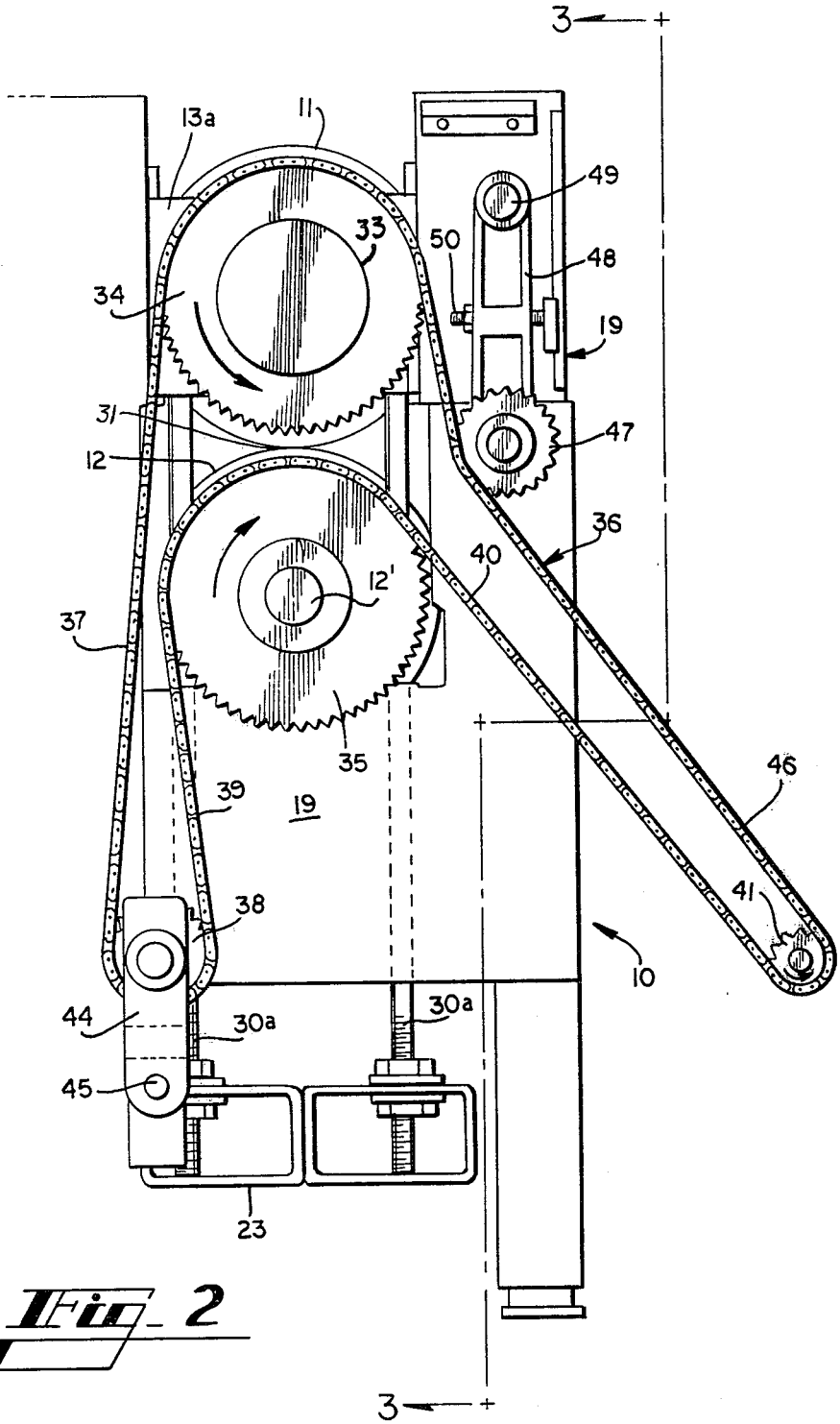
FIG. 2 is an elevation view taken from the left side of FIG. 1, with panels removed to show details of the roll drive mechanism according to a first embodiment of the present invention.

Details of a mechanism for driving the top and bottom rolls 11 and 12 are shown in FIG. 2. The rolls are secured to the respective drive shafts 11' and 12', and sprocket 35 is keyed into driving engagement with the drive shaft 12' for the bottom roll. The drive shaft 11' for the top roll 11 is keyed to the driven element of a variable torque drive such as the air-loaded torque limiter 33 or equivalent. The driving or input element of the torque limiter 33 is driven by the sprocket 34. A drive chain 36 engages the sprocket 34 around approximately 180° at the upper side of the sprocket, as shown in FIG. 2. The drive chain extends downwardly from the sprocket 34, as shown at 37, to engage and wrap around the idler sprocket 38, and returns upwardly at 39 from the idler sprocket to wrap around the top portion of the sprocket 35 driving the bottom roll 12. The idler sprocket 38 is carried by the idler bracket 44, which in turn is attached by the pivot connection 45 to the load and lift beam 23. The idler sprocket 38 thus is raised and lowered by vertical movement of the beam 23, to the same extent and direction that the top roll 11 is raised and lowered.

The chain 36 leaves the sprocket 35 as shown at 40, and extends forwardly and downwardly to engage the drive input sprocket 41 in front of the apparatus 10. The drive input sprocket is connected to any appropriate source of motive power, such as a line shaft drive associated with an overall sizing and drying apparatus, or alternatively may be connected to a separate motor provided with its own control. As seen in FIG. 2, the wrap of the drive chain 36 across the sprockets 34 and 35 imparts counter-rotation to those sprockets and their associated rolls 11 and 12, when the input sprocket 41 is driven.

The drive chain 36, on its return or slack run 46 from the drive input sprocket 41, passes over another idler sprocket 47 mounted at the lower end of the chain tension adjusting arm 48. The adjusting arm 48 is pivotally mounted at 49 to the fixed frame assembly 19. A threaded adjustment member 50 selects the position of the adjusting arm 48, and thus adjusts the position of the idler sprocket 47 relative to the slack chain run 46 leading to the sprocket 34 associated with the top roll 11.

The drive chain 36 is selected to transmit to the top and bottom rolls the maximum drive torque to be encountered in operation for which the apparatus 10 is designed. As pointed out below, the maximum tension anticipated in the drive chain can be reduced by appropriate selection of roll diameters. In a specific embodiment of the present invention with a maximum design squeeze loading of 345 pounds per linear inch (PLI), a top roll triple drive chain having one-half inch pitch is satisfactory.

The variable torque limiter 33 is preferably operated to provide a selectably variable maximum drive torque determined in proportion to the particular squeeze loading of the rolls 11 and 12. One way of accomplishing this variable control is shown in FIG. 6. The variable torque limiter 33 is connected to a control air line 42, which receives air pressure through an adjustable ratio air valve 43. The adjustable ratio air valve 43 is connected to receive and sense air pressure supplied to the loading elements 26 from the squeeze load control valve 16'. The adjustable ratio air valve 43 operates in a manner known to those skilled in the art to apply air pressure to the control line 42 at a pressure in predetermined selected ratio to the air pressure supplied to the loading element 26 by squeeze load control valve 16'. Because the control air pressure supplied to the variable torque limiter 33 determines the maximum amount of torque transmitable from the drive sprocket 34 to the top roll drive shaft 11', this maximum torque to the top roll is automatically varied in response to the amount of squeeze loading. The variable torque limiter 33 thus acts as a variable slip clutch to drive the top roll at a variable maximum torque determined as a function of the selected squeeze loading. The ratio between selected squeeze loading and maximum torque transmission capacity is determined by selectable adjustment of the adjustable ratio air valve 43.

Considering now the operation of the embodiment as described thus far, it will be appreciated that the top roll 11 is raised and lowered as the lift and load beam 23 is raised or lowered by selective inflation of the lifting elements 24 or the loading elements 26. Furthermore, the PLI loading of warp yarns pinched between the rubber covered top roll 11 and the stainless steel bottom roll 12 is determined by the magnitude of downward loading force exerted on the beam 23 by inflation of the loading elements 26. The loading force imparted to the top roll 11, and thus the squeeze loading applied to the warp yarns pinched in the nip 31 between the rolls, is relatively unaffected by the amount of tension in the drive chain 36, inasmuch as the idler sprocket 38 moves vertically with the beam 23 and with the top roll 11. That is, the vertical component of the chain tension applied to the top roll sprocket 34 is approximated balanced in the embodiment of FIG. 2, and fully balanced in the embodiment of FIG. 5, by the idler sprocket 38, the beam 23, and the connecting rods **30*a*, 30*b* which are rigidly connected to the bearing blocks 13*a*, 13*b* supporting the top roll. Thus, the amount of squeeze loading imparted by the present apparatus 10** is substantially independent of the amount of tension in the drive chain connected to the top and bottom rolls.

The top roll 11, as mentioned previously, is subject to two rotational forces whenever that roll peripherally engages the bottom roll and the drive chain 36 is driven by the drive input sprocket 41. The first of these rotational forces is the torque applied by the drive chain 36 acting on the sprocket 34 associated with the top roll 11. The second rotational force is imparted directly to the top roll 11 by frictional surface engagement with the bottom roll, in much the manner associated with sizing low-pressure squeeze apparatus of the prior art. If the present sizing squeeze apparatus 10 is operated at relatively low squeeze loadings, for example, 10–30 PLI, the amount of frictional slippage in surface drive of the top roll 11, and the change in circumference of the top roll due to rubber deformation, are relatively negligible. As squeeze loading pressures are increased, so does slippage, and an increased amount of torque must be supplied from the drive chain 36 to maintain the desired rotation of the top roll 11. Moreover, the top roll 11 undergoes substantial rubber strain when subjected to relatively high squeeze loading, and the rubber strain distorts the surface of the top roll by increasing the effective circumference of the top roll. This increase in effective circumference of the top roll 11 decreases the axial velocity at which the top roll is rotated by peripheral engagement with the driven bottom roll 12. This underdrive or decrease in the velocity of rotational drive due to the increase in effective circumference, combined with the increased slippage of the surface drive at higher squeeze loadings, causes the velocity of the top roll 11 to lag even further behind the bottom roll 12. With squeeze loadings in the order of 320 PLI or greater, which are theoretically possible while maintaining the desired % add-on with sizing products presently available, the amount of drive torque required to maintain rotation of the top roll 11 may increase beyond the point of practical application, at least with an economical effective circumference of the rubber covered top roll 11 under high squeeze loading affected by the hardness of the rubber, with harder rubber permitting somewhat increased squeeze loading. Rubber having hardness in the range of 65–90 Shore A durometer has been successfully used for the top roll surface, in embodiments of the present invention. The thickness and other characteristics of the warp yarn being squeezed also can affect the maximum possible squeeze loading before substantial changes of effective circumference and slippage occurs.

The maximum drive torque requirements for the top roll 11 at higher squeeze loadings can be minimized by forming the top roll to a diameter slightly less than the diameter of the bottom roll. For example, the uncompressed nominal diameter of the top roll 11 may be selected so that the surface speed of the top roll is 1% less than the surface speed of the lower roll, when both rolls are driven by the drive chain 36 engaging identical sprockets 34 and 35. When these two rolls are brought together at relatively light squeeze loading, the slightly greater surface velocity of the steel bottom roll tends to overdrive the rubber-covered top roll at an angular velocity slightly greater than that at which the sprocket 34 is rotated by the drive chain 36, so that the drive chain is actually slack on the normal driving side 37. As the squeeze loading is increased by increasing the downward load on the beam 23, increased slippage in the surface drive of the top roll 11 reduces the amount of overdrive to a point where the chain is slack on both sides of the top roll sprocket 34, and the power required to drive the top roll is transmitted entirely through friction contact with the bottom roll. This condition is considered a null point, and it is chosen to occur at some point (not necessarily the midpoint) between minimum and maximum squeeze loads for which the particular machine 10 is designed.

When the squeeze load is increased beyond the null point, with a corresponding increase in surface drive slippage between the top and bottom rolls, the chain 36 becomes tight on the driving side 37 and the amount of torque transmitted through the chain to the top roll 11 increases. It will be understood that the amount of driving torque delivered to the top roll by the drive chain at maximum squeeze loading is substantially reduced with the slightly undersize top roll, inasmuch as the drive chain does not commence delivering torque to the top roll at the lower range of squeeze loads.

With the variable torque limiter 33 operating as described above, so as to prevent the top roll 11 from receiving axial torque exceeding the required driving torque for a particular squeeze loading, the drive chain can operate to maintain tension in the driving chain side 37 at all times. The drive chain thus can be said to overdrive the top roll 11, with the variable torque limiter 33 keeping the top roll from receiving axial torque substantially exceeding the torque needed to maintain the top roll velocity notwithstanding slippage and changes in effective circumference of the top roll, at a particular squeeze loading. The variable torque limiter also protects the drive chain 36 and other elements of the rigid drive from damage from excessive torque requirements.

During periodic maintenance of the sizing squeeze apparatus 10, the surface of the rubber top roll 10 is ground to remove degraded surface rubber. This rubber is removed to a predetermined diameter, and a new upper drive sprocket 34 is then substituted to provide the desired surface speed for the refinished top roll. In practical application, each substitute drive sprocket will have one less tooth than the sprocket it replaces, and the amount of surface rubber removed by grinding is calculated to yield the desired relative surface speed with the known substitute drive sprocket.

Figure 5:
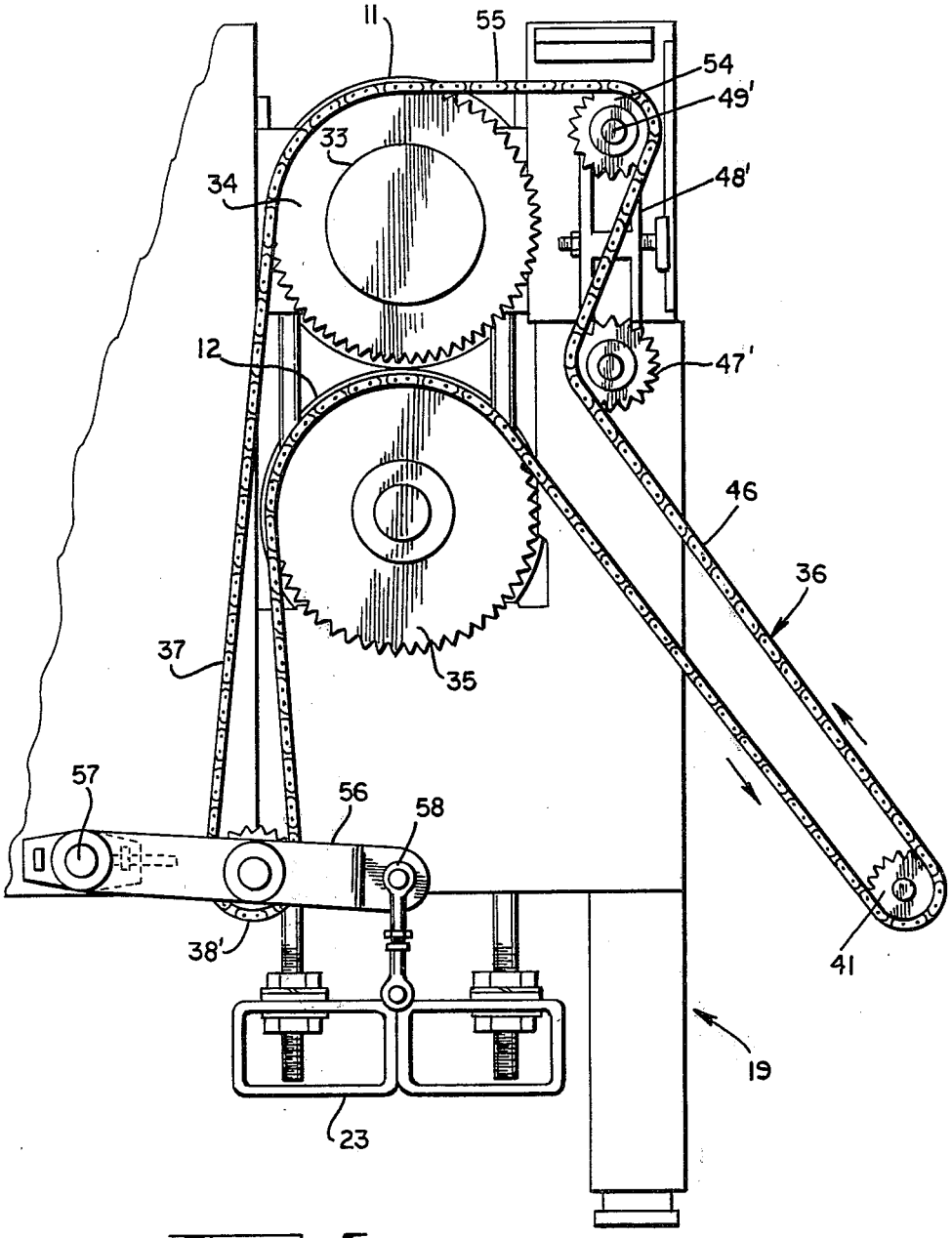
FIG. 5 is an elevation view showing another disclosed embodiment of drive mechanism, alternative to that shown in FIG. 2.

Turning next to FIG. 5, there is shown an alternative embodiment of the present invention utilizing a somewhat different mechanical drive arrangement to fully compensate for the effect of tension in the drive chain, as the top roll is raised or lowered. The nominally-slack span 46 of drive chain from the drive input sprocket 41 passes over a first idler sprocket 47' mounted on the chain tension adjusting arm 48', somewhat comparable to the correspondingly-numbered elements shown in FIG. 2. Once the chain 36 passes over the idler sprocket 47, however, the chain goes around a second idler sprocket 54, positioned so that the length of chain 55 leaves the second idler sprocket and travels along a substantially horizontal path to engage the drive sprocket 34 of the top roll 11. The second idler sprocket 54 may be mounted concentrically with the pivot 49' of the chain tension adjusting arm 48.

The driven length of chain 37 extending downwardly from the top roll drive sprocket 34 passes around an idler sprocket 38', whose function is similar to that of idler sprocket 38 in FIG. 2. The idler sprocket 38', however, is mounted on the lever 56, pivotably affixed at 57 to the fixed frame assembly 19 and connected at 58 to the lift and load beam 23. The effective length of the lever 56 between its pivot 57 and the beam connection 58, along with the mounting point of the sprocket 38' on the lever, are selected to equalize the vertical component of chain tension as the top roll 11 is raised or lowered by the beam 23. Thus, the squeeze loading of the rolls is unaffected by changes in the tension of the drive chain. It will also be seen that any tension in the horizontal length 55 of drive chain approaching the sprocket 34 does not have a vertical component to affect the squeeze loading of the top roll.

It should be understood that the two disclosed drive arrangements are by way of example, and that alternative drive arrangements may be provided to meet the requirements of this invention and to prevent drive tension from affecting the squeeze loading. It will also be understood that the present invention is not restricted to using chain drive for the rolls, and that other sources of driving torque may be employed where appropriate.

It should also be understood that the foregoing relates only to specific embodiments of the present invention, and that numerous changes and modifications may be made without departing from the spirit and the scope of the invention as defined in the following claims.

We claim:

1. Apparatus for squeezing a slippery wet material web to remove at least some of the liquid from the material as the web moves along a path, comprising:

a first roll across which the material web passes;

a second roll disposed to press against the first roll with the material web squeezed between said two rolles;

means operative to drive said first roll at a predetermined speed related to the movement of the web along the path, so as to tend to rotate said second roll by surface contact with the first roll subject to increasing slippage of the second roll as the squeeze force increases;

drive means operative to rotate said second roll at a certain angular velocity bearing a predetermined relation to the drive speed of said first roll so as to compensate for said slippage in drive imparted to said second roll by surface contact from said first roll; and the surface speed of said second roll is less than the surface speed of said first roll by a predetermined amount so that surface contact with said first roll at squeezing force less than an initial amount tends to drive the second roll at an angular velocity slightly greater than said angular velocity of said drive means, thereby reducing the driving torque supplied by said drive means to said second roll when said surface contact slips due to squeezing forces exceeding said initial amount.

2. Apparatus as in claim 1, wherein:

said first roll has a substantially noncompressible web engaging peripheral surface;

said second roll has a resilient peripheral surface for engaging the peripheral surface of said first roll and the web squeezed between the two rolls, so that the effective radius between the axis of said second roll and the peripheral surface of said first roll is determined by compression of said resilient peripheral surface of said second roll.

3. Apparatus as in claim 1, further comprising:

means mounting said first and second rolls for selectably variable relative spacing so as to vary the squeeze loading exerted on the web moving between the two rolls, within a certain desired range of squeeze loading; and wherein one of said rolls has a peripheral surface which is compressible relative to the peripheral surface of the other roll, in response to variation in the squeeze loading, so that the effective radius of said one roll is affected by said squeeze loading.

4. Apparatus as in claim 3, wherein said one roll is said second roll; and the uncompressed diameter of said second roll is selected so that the torque supplied to said second roll by said drive means is null in response to surface contact drive slippage encountered at a selected squeeze loading within said certain range of squeeze loading, whereby torque is supplied to said second roll to compensate for slippage at squeeze loading exceeding said selected squeeze loading.

5. Apparatus as in claim 4, wherein:

said drive means to drive the second roll comprises means mechanically interconnecting said means driving the first roll, so that said mechanical interconnecting means transmits drive torque to said second roll at squeeze loadings greater than said selected squeeze loading and receives driven torque from the second roll at squeeze loadings less than the selected squeeze loading.

6. Apparatus for squeezing a slippery wet material web to remove at least some of the liquid from the material as the web moves along a path, comprising:

a first roll across which the wet material web passes;

a second roll disposed to press against the first roll with the material web squeezed between said two rolls at a selectably variable squeeze pressure;

means operative to drive said first roll at a predetermined speed related to the movement of the web along the path, so that the driven first roll rotates said second roll by surface friction contact which exhibits increasing slippage relative to the first roll and the wet material web as the squeeze pressure is increased, and drive means operative as the wet material web is squeezed between the two rolls to axially drive said second roll at an axial driving torque limited not to exceed a predetermined maximum torque so that torque at least partially compensating for said slippage is applied to the second roll as the wet material web is squeezed between said rolls, so as to limit the slippage irrespective to the squeeze pressure.

7. Apparatus as in claim 6, wherein:

said drive means is operative in response to said variable squeeze pressure to adjust the maximum axial driving torque applied to said second roll, thereby increasing the maximum axial drive torque available to compensate for slippage and under-speed driving of said second roll by surface contact as the selected squeeze pressure increases.

8. Apparatus as in claim 6, wherein:

said drive means comprises torque limiting means connected to a source of drive input and operative to impart axial drive to said second roll at a selectably variable maximum amount of torque; and further comprising:

first means selectably operative to adjust the squeeze pressure between said first and second rolls; and second means operatively associated with said torque limiting means and operative in response to the squeeze pressure selected by said first means to increase said maximum torque transmittable by said torque limiting means in response to increased squeeze pressure.

9. The method of removing liquid from a wet web of material, comprising the steps of:

pinching the wet web between a pair of rolls in squeezing engagement;

driving one of said rolls at a predetermined surface speed to move the web between the rolls;

imparting a first increment of driving force to the other said roll by surface contact between the two rolls, subject to increasing slippage between the engaged roll surfaces and the wet web as the squeeze pressure increases;

imparting a second increment of driving force to said other roll by axially driving said other roll tending to provide a surface speed greater than said predetermined peripheral velocity of said one roll; and limiting the amount of axial driving torque for said second increment of rotation to a predetermined maximum torque which at least partially overcomes the reduction of said first increment of driving force due to slippage, so that said second increment of driving force does not exceed a predetermined force needed to maintain the surface speed of said other roll relative to the speed of the wet web pinched between the rolls.

10. The method as in claim 9, comprising the additional steps of:

pinching the web between said pair of rolls at a selectably variable squeeze pressure; and adjusting said maximum axial driving torque to the other roll in response to said variable squeeze pressure so as to increase the maximum axial driving torque to the other roll in response to increased squeeze pressure, thereby tending to compensate for increased slippage of the other roll at increased selected squeeze pressure.

11. Apparatus for squeezing a warp of wet yarn to remove at least some of the moisture from the yarn, comprising:

a first roll across which the warp passes;

a second roll disposed to press against said first roll with the warp yarns squeezed between the two rolls;

means movably mounting said second roll along a predetermined path for selectably variable spacing between the two rolls, so as to selectably vary the squeeze loading applied to the warp yarns;

drive means connected to supply drive torque to said second roll; and said drive means being operatively interconnected to move along said predetermined path with said mounting means as the position of said second roll varies, so that the squeeze loading is unaffected by variations in the drive torque supplied to said second roll by said drive means.

12. Apparatus as in claim 11, wherein said drive means comprises a mechanical interconnection between said movably mounted second roll and a fixed drive means; and further comprising:

means movable along said predetermined path to maintain substantially invariant tension in said mechanical interconnection in response to selectable mounting movement of said second roll.

13. Appparatus as in claim 11, wherein:

said drive means comprises endless means mechanically interconnecting said movably mounted second roll with a fixedly mounted drive means; and further comprising:

idler means operatively engaging said endless means and movable along said predetermined path with said movable mounting means to maintain a predetermined tension on said endless means as the spacing of said second roll is varied relative to said first roll.

14. Apparatus for squeezing a warp of wet yarn to remove part of the moisture from the yarn, comprising:

a first roll across which the web passes;

a second roll disposed to press against said first roll with the warp yarns squeezed between the two rolls;

means movably mounting said second roll along a predetermined path for selectably variable spacing between axes of the two rolls, so as to seletably vary the squeeze loading applied to the warp yarns;

endless flexible drive means operatively engaging said first and second rolls to counter-rotate said rolls and having a portion extending along said predetermined path and normally in tension relative to said second roll; and idler means operatively engaging said drive means portion and movable along said predetermined path with said movable means to maintain substantially unchanged the length of said portion, so as to maintain substantially invariant tension exerted on said second roll by said drive means irrespective of the spacing of said second roll relative to said first roll.

15. Apparatus as in claim 14, further comprising:

a separate drive member connected to each of said rolls;

said endless flexible drive means positively engaging each drive member and being connectable to a motive source, so as to impart to said rolls a counter-rotating movement in a direction tending to move the warp yarns through the rolls;

said drive means portion extending along said predetermined path to said idler means located beyond the drive member for said first roll, and returning from the idler means to the first roll drive member; and said idler means moving in response to said relative movement of the second roll to maintain a predetermined distance in said flexible drive means along said predetermined path to said idler means irrespective of the relative squeeze position of the second roll.

16. Apparatus as in claim 14, further comprising:

first frame means mounting said first roll;

second frame means mounting said second roll;

support means movably disposed relative to said first frame means and operativ to support said second frame means;

said movable support means including first selectably expandable means operative to move the second frame means tending to bring said two rolls closer together, and second selectably inflatable means operative to move the second frame means tending to separate the two rolls; and said idler means is mounted with said second frame means to undergo movement in response to said movement of the second frame means, so as to maintain a predetermined tension in said flexible drive means irrespective of the position of said second roll relative to said first roll.

* * * * *